US009578997B2

(12) United States Patent
Welch

(10) Patent No.: US 9,578,997 B2
(45) Date of Patent: Feb. 28, 2017

(54) VACUUM SEALED CLOTHING AND DIAPER CHANGE KIT AND METHODS OF MANUFACTURING THE SAME

(71) Applicant: Diana E. Welch, Oklahoma City, OK (US)

(72) Inventor: Diana E. Welch, Oklahoma City, OK (US)

( * ) Notice: Subject to any disclaimer, the term of this patent is extended or adjusted under 35 U.S.C. 154(b) by 331 days.

(21) Appl. No.: 14/467,331

(22) Filed: Aug. 25, 2014

(65) Prior Publication Data

US 2015/0060323 A1 Mar. 5, 2015

Related U.S. Application Data

(60) Provisional application No. 61/870,785, filed on Aug. 28, 2013.

(51) Int. Cl.

| | |
|---|---|
| ***B65D 69/00*** | (2006.01) |
| ***A47K 7/00*** | (2006.01) |
| ***B65D 81/20*** | (2006.01) |
| *B65D 75/56* | (2006.01) |
| *B65D 75/58* | (2006.01) |
| *B65D 5/42* | (2006.01) |

(52) U.S. Cl.

CPC ..... *A47K 7/00* (2013.01); *B65D 81/2015* (2013.01); *B65D 81/2023* (2013.01); *B65D 5/4208* (2013.01); *B65D 5/4212* (2013.01); *B65D 75/56* (2013.01); *B65D 75/58* (2013.01)

(58) Field of Classification Search

CPC .... B65D 5/4208; B65D 5/4212; B65D 75/56; B65D 75/58; B65D 81/2023; B65D 81/2038

USPC .... 206/438, 440, 461, 466, 467, 494, 524.8, 206/581

See application file for complete search history.

(56) References Cited

U.S. PATENT DOCUMENTS

| | | | | |
|---|---|---|---|---|
| 2,533,850 | A * | 12/1950 | Syracuse | A45C 3/00 150/112 |
| 4,702,378 | A | 10/1987 | Finkel et al. | |
| 5,443,161 | A | 8/1995 | Jonese | |
| 6,723,080 | B1 | 4/2004 | Habib et al. | |
| 7,150,354 | B2 * | 12/2006 | Snell | A61F 13/15747 206/223 |
| 7,178,312 | B2 | 2/2007 | Snell | |
| 7,181,893 | B2 | 2/2007 | Snell | |
| 7,181,894 | B2 | 2/2007 | Snell | |
| 7,194,848 | B2 | 3/2007 | Snell | |
| 7,231,751 | B2 | 6/2007 | Snell | |
| 7,243,477 | B2 | 7/2007 | Snell | |
| D560,802 | S | 1/2008 | Stratton | |
| 7,520,387 | B2 | 4/2009 | Snell | |
| 7,770,733 | B2 * | 8/2010 | Snell | A61F 13/15747 206/440 |
| 7,779,610 | B2 | 8/2010 | Snell | |

(Continued)

*Primary Examiner* — Luan K Bui

(74) *Attorney, Agent, or Firm* — Patentfile, LLC; Bradley C. Fach; Steven R. Kick

(57) ABSTRACT

In preferred embodiments, a vacuum sealed clothing and diaper change kit is provided which may comprise a clothing article, a diaper, and optionally a changing aid together utilizing a folding and vacuum sealing processes as to reduce the total size of the contents and provide hygienic storage and transportation of contents. In further preferred embodiments, a kit may comprise an outer casing.

12 Claims, 6 Drawing Sheets

(56) References Cited

U.S. PATENT DOCUMENTS

| | | | | |
|---|---|---|---|---|
| 8,047,375 | B1 | 11/2011 | Hartsfield | |
| 8,069,988 | B2 | 12/2011 | Snell | |
| 8,342,333 | B2 | 1/2013 | Snell | |
| 8,944,252 | B2 | 2/2015 | Snell | |
| 2004/0172002 | A1* | 9/2004 | Nelson | A61F 13/15747 604/385.02 |
| 2005/0155891 | A1* | 7/2005 | Chen | B65D 5/3628 206/524.8 |
| 2006/0283205 | A1* | 12/2006 | Carriere | A45C 13/02 62/457.2 |
| 2007/0151895 | A1* | 7/2007 | Patterson | A45C 11/00 206/581 |

* cited by examiner

VACUUM SEALED CLOTHING AND DIAPER CHANGE KIT AND METHODS OF MANUFACTURING THE SAME

CROSS REFERENCE TO RELATED APPLICATIONS

The present application claims priority to co-pending U.S. provisional patent application No. 61/870,785 filed Aug. 28, 2013 and entitled "VACUUM SEALED CLOTHING AND DIAPER CHANGE KIT" the entire contents of the above-referenced patent application is incorporated by reference herein.

FIELD OF THE INVENTION

The present invention relates to diaper changing kits. More specifically, the invention relates to a diaper changing kit that is both functional and space saving as well as methods of manufacturing the same.

BACKGROUND

Caregivers of infant and toddler children often experience the need to carry supplies such as clothes, diapers, and related diaper changing accessories with them wherever they go. Time and effort are associated with preparing and gathering all of these items and often times a caregiver may forget to pack all or some of these items prior to leaving their residence. In addition to the time and effort of preparing and gathering these supplies, the amount of space required to store and travel with these items can be inconvenient. Furthermore, a risk exists for these items to become lost, soiled, or damaged when stored within a diaper bag, purse, pocket, or other container.

In daily child rearing life, where time and space efficiency is generally at a premium, a solution is needed that offers time savings and convenience while providing childcare needs such as a clean change of clothes, fresh diapers, and the means for cleaning the child's diaper area. Such a solution would make it easier and thus more likely for a caregiver to have ready access to the necessary supplies of clothing, diaper, and care accessories. Therefore, a need exists for a new type of diaper changing kit that provides a small space saving footprint while providing all of the necessary supplies to change a child's diaper and soiled clothing.

BRIEF SUMMARY OF THE INVENTION

In preferred embodiments, a vacuum sealed clothing and diaper change kit and methods of manufacturing the same are provided. The kit enables the convenient procurement of changing supplies and comprises a change of clothing, a diaper, and a changing aid in a space-saving package that helps to protect the package contents from becoming damaged or lost during transport and storage. A vacuum sealed clothing and diaper change kit serves to aid with emergency situations, such as instances where a child's diaper and clothing become soiled and need changing and provide convenience to caregivers who need a contingent change of clothes and diaper or who may have otherwise forgot to pack such supplies.

In preferred embodiments, a vacuum sealed clothing and diaper change kit may comprise a unique combination of clothing, diaper, and a changing aid or means for changing the diaper such as a diaper changing accessory contained together within a vacuum sealed container.

In further preferred embodiments, a vacuum sealed clothing and diaper change kit may comprise an article of clothing and a diaper together utilizing a folding and vacuum sealing packaging processes as to reduce the total size of the contents and provide hygienic storage and transportation of contents while also providing an option for a method for facilitating easy access to the contents, thus eliminating the need to have a sharp instrument on hand such as scissors or knife for opening the kit.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New clothing and diaper change kits, as well as methods for creating kits are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
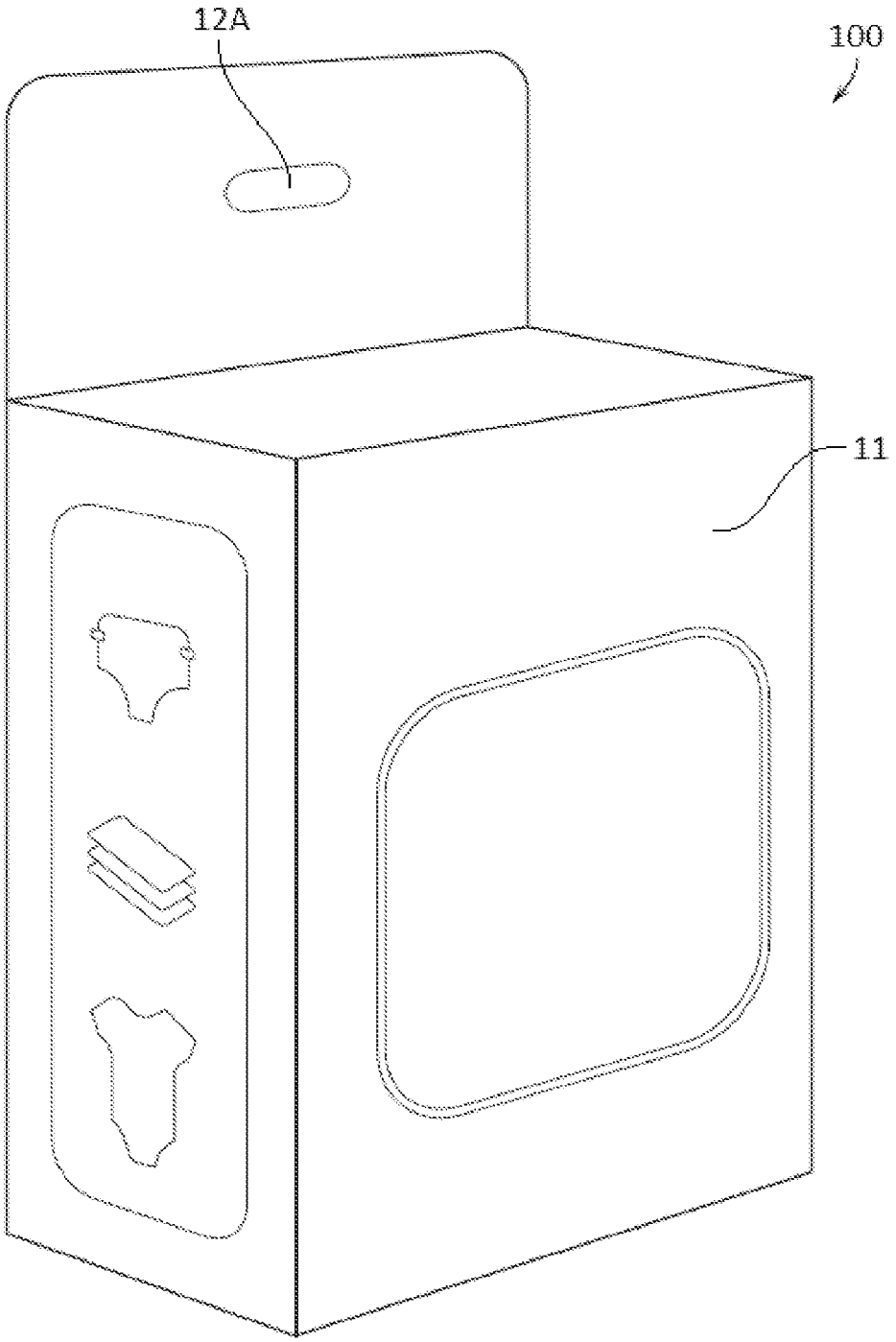
FIG. 1 depicts a perspective view of an example of a vacuum sealed clothing and diaper change kit according to various embodiments described herein.

The present invention will now be described by example and through referencing the appended figures representing preferred and alternative embodiments. FIG. 1 illustrates an example of a vacuum sealed clothing and diaper change kit ("the kit") 100 according to various embodiments. In some preferred embodiments, a kit 100 may comprise one or more clothing article 13 (FIG. 2), one or more diaper(s) 14 (FIG. 2), and a changing aid 15 (FIG. 2), together resulting in a single inclusive space-saving hygiene kit suitable to facilitate the changing of an infant or toddler aged child.

In some embodiments, a kit 100 may comprise an outer casing 11 suitable for storing and presenting the kit 100 for retail use. An outer casing 11 may be constructed from a flexible or rigid material such as cardboard, paper, plastic, or fabric material and may contain printed text and images identifying the contents of the kit 100, printed text and images identifying other information beneficial for sale of the kit, printed inserts, and features that allow the outer casing 11 to be displayed or stored on retail shelf space. The kit 100 may be packaged in an outer casing 11 such as retail packaging suitable for single or multi-unit consumption or even packaged within other kits.

In some embodiments, an outer casing 11 may be constructed in a generally rectangular or square shape as depicted in FIG. 1. In other embodiments, an outer casing 11 may be configured as a generally cylinder shaped, cuboid shaped, hexagonal prism shaped, triangular prism shaped, or any other geometric or non-geometric shape. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

As further shown in FIG. 1, in some embodiments, the kit 100 is enclosed in an outer casing 11 for retail use. The example shows kit 100 enclosed by an outer casing 11 said outer casing 11 constructed as a cardboard box that may be printed with text, graphics, or other indicia identifying the contents of the kit 100, directions for accessing the contents of the kit 100, and/or other marketing text or other indicia suitable for retail sale. In other embodiments, an outer casing 11 can include any other material or printed substrate preferably suitable for retail use.

In accordance with aspects of the invention, the kit 100 and/or outer casing 11 may comprise one or more carrying accessories to aide with transporting and storing the kit 100. In the embodiment depicted in FIG. 1, the outer casing 12 of the kit 100 comprises an aperture type hanging or carrying accessory opening 12A suitable for receiving hooks and rack rails commonly used in retail storage settings. A carrying accessory opening 12A may be configured to accept one or any combination of: a fixed size lanyard, an adjustable size lanyard, a traditional hook, an "S" hook, a belay hook, a lobster claw clasp, and/or a carabineer. In some examples, a carrying accessory opening 12A may be formed within the kit 100 or formed within the outer casing 11. In other embodiments, a carrying accessory opening 12A may be an aide in connecting the kit 100 to an object commonly employed with young children and caregivers, including but not limited to diaper bags, backpacks, purses, strollers, car seat carriers, on-person baby carriers, automobile seat pockets, bicycles, or wrists.

Figure 2:
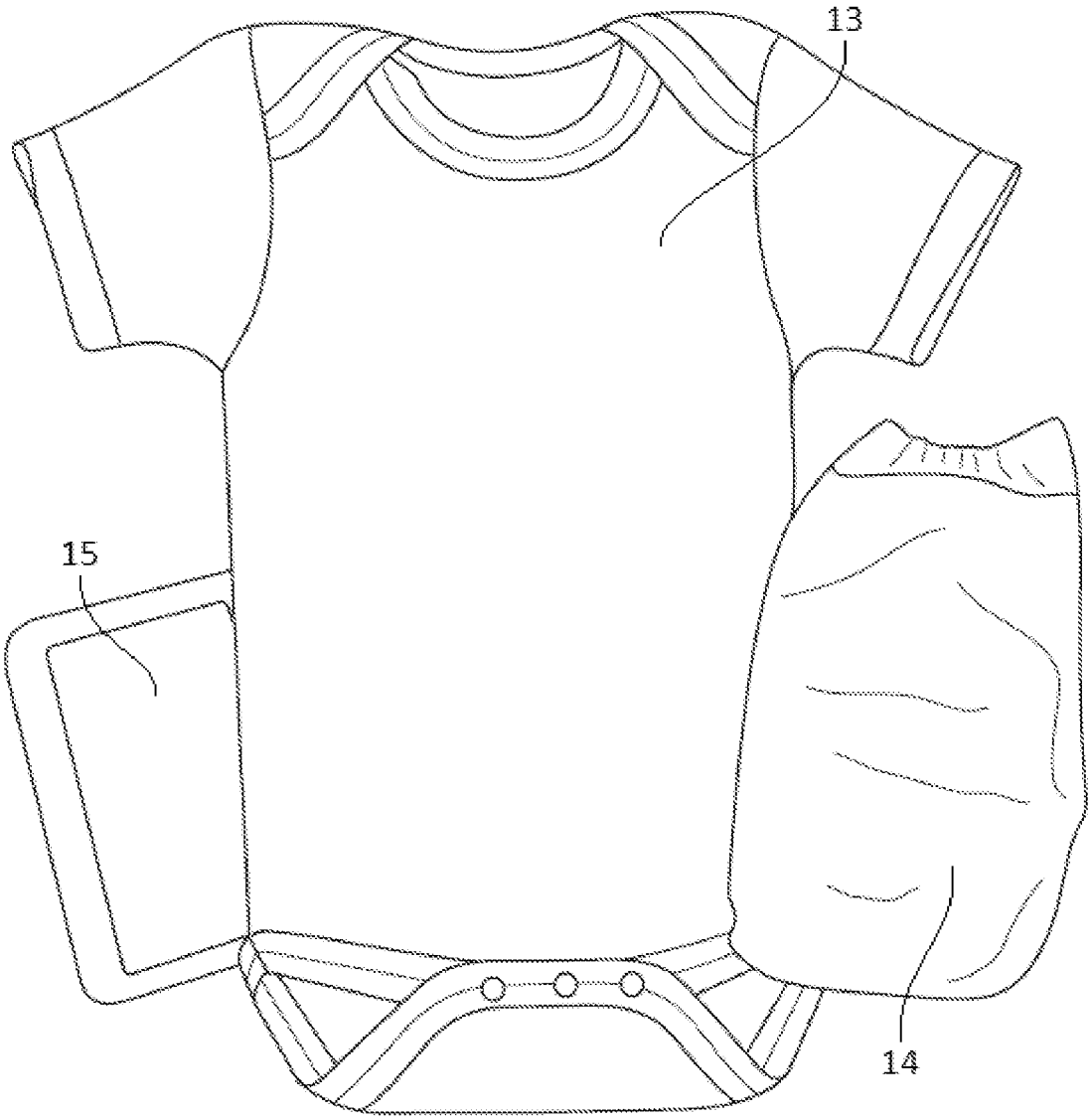
FIG. 2 illustrates an elevation view of examples of elements that a vacuum sealed clothing and diaper change kit may comprise according to various embodiments described herein.

FIG. 2 illustrates an elevation view of examples of various items contained within a vacuum sealed clothing and diaper change kit 100 (FIGS. 1, 3 and 4) according to embodiments described herein. FIG. 2 presents a clothing article 13, a diaper 14, and a changing aid 15 that may be included in the kit 100, prior to folding and packaging within a kit 100.

In accordance with some preferred embodiments, a kit 100 (FIGS. 1, 3 and 4) may comprise one or more clothing articles 13. Clothing article 13 is typically of a size and style generally worn by children ages newborn through 48 months. In preferred embodiments, specific clothing article 13 sizes and styles may range from newborn through 4T. In other embodiments, clothing article 13 sizes and styles may range from 4T up to and including adult sizes. A clothing article 13 can be laundered or non-laundered and of any color, pattern, print, or fiber blend suitable for clothing. In some embodiments, clothing article 13 style and types in a kit 100 may include clothing such as a onesie, a dress, a gown, a shirt, pants, shorts, socks, a hat, and the like. Clothing article 13 designs and prints may include but are not limited to solid colors, stripes, polka dots, stars, flowers, or any other type of fabric designs and prints. Additionally, clothing article 13 fiber blend or composition may include but is not limited to synthetic fabrics such as polyester, acrylic, nylon, rayon, acetate, spandex, latex, and Kevlar, and natural fabrics such as coir, cotton, hemp, jute, leather, linen, ramie, wool, silk, or any other suitable flexible natural or synthetic material including combinations of materials.

As shown in the embodiment in FIG. 2, a clothing article 13 may be comprised of a style or type commonly referred to as a onesie. In other embodiments, the kit 100 (FIGS. 1, 3 and 4) may comprise one or more clothing articles 13 which may be of a style or type of dresses, gowns, shirts, pants, shorts, socks, hat, or the like. A clothing article 13 may be preferably folded one or more times so as to reduce the overall length and/or width of the clothing article 13 so as to reduce the length and/or width by about 25 to 75% for insertion into the kit 100. In some embodiments, a clothing article 13 may be folded into a rectangular or square configuration or shape. In other embodiments, a clothing article 13 may be folded or rolled into a cylindrical configuration or shape. It should be understood to one of ordinary skill in the art that a clothing article 13 may be folded so as to reduce the overall length and width into a plurality of sizes and shapes suitable for inclusion in a kit including rectangular shapes, cuboid shapes, hexagonal prism shapes, triangular prism shapes, or any other geometric or non-geometric shape including combinations of shapes. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

In accordance with preferred embodiments, the kit 100 (FIGS. 1, 3 and 4) may comprise one or more diapers 14. In preferred embodiments, a diaper 14 may be disposable or non-disposable diaper and configured in a size that may generally correspond to sizes generally worn by children ages newborn through 48 months. In other embodiments, a diaper 14 may be configured in a larger size up to and including adult sizes. Types of diapers 14 may include but are not limited to traditional front closure diapers and side closure training diapers or pull-ups.

Figure 3:
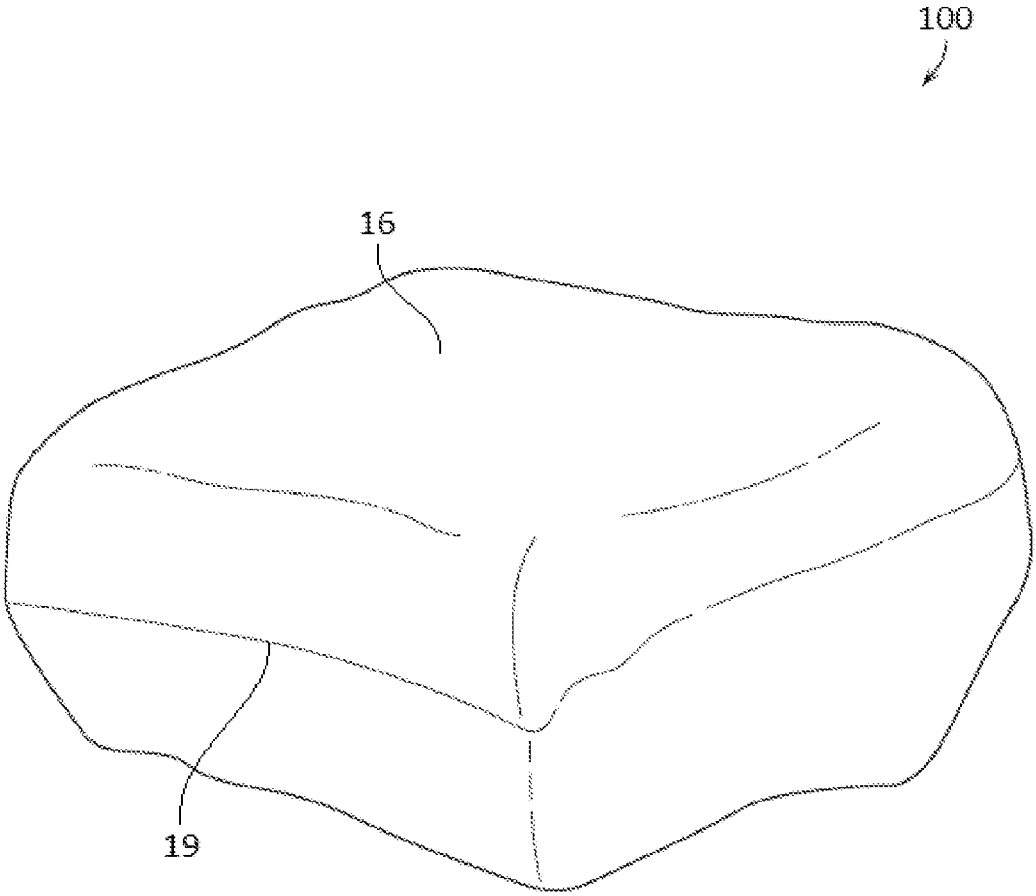
FIG. 3 shows a perspective view of an example of a vacuum sealed clothing and diaper change kit according to various embodiments described herein.

A diaper 14 may be preferably folded one or more times so as to reduce the overall length and/or width of the diaper 14 so as to reduce the length and/or width by about 25% to 75% for insertion into the kit 100 (FIGS. 1, 3 and 4). In some embodiments, a diaper 14 may be folded into a rectangular or square configuration or shape. In other embodiments, a diaper 14 may be folded or rolled into a cylindrical configuration or shape. It should be understood to one of ordinary skill in the art that a diaper 14 may be folded so as to reduce the overall length and width into a plurality of sizes and shapes suitable for inclusion in a kit including rectangular shapes, cuboid shapes, hexagonal prism shapes, triangular prism shapes, or any other geometric or non-geometric shape including combinations of shapes. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

In accordance with some preferred embodiments, the kit 100 (FIGS. 1, 3 and 4) may comprise one or more changing aids 15 or means for assisting the changing the diaper 14 of a child. In some embodiments, changing aid 15 may be packaged within its own sealed package or container to avoid direct contact between the aid 15 and other contents within the kit 100. A changing aid 15 may include but is not limited to one or any combination of moistened wipes, towelettes, dry wipes, over-the-counter medicated creams, over-the-counter medicated lotions, over-the-counter medicated ointments, prescription creams, prescription lotions, prescription ointments, non-medicated creams, non-medicated lotions, non-medicated ointments, powders, hand sanitizer, odor masking/diffuser such fragrance wipes, and/or diaper disposal bags.

As shown in the embodiment illustrated in FIG. 2, a changing aid 15 may comprise one or more packages of over-the-counter medicated cream such as diaper rash ointment or moistened wipes. A changing aid 15 may be configured in package sizes of a compatible size for inclusion in a kit 100 (FIGS. 1, 3 and 4) and may preferably be of a length and width of approximately the same size or smaller than a folded clothing article 13 and/or a folded diaper 14. In other embodiments, a kit 100 may comprise one or more diapers 14 and clothing articles 13 with one or more changing aids 15 arranged or folded to a length and width of approximately the same size or smaller than folded clothing articles 13 and/or folded diapers 14 in the kit 100.

FIG. 3 shows a perspective view of an example of a vacuum sealed clothing and diaper change kit 100 (FIGS. 1, 3 and 4) according to various embodiments described herein. In preferred embodiments, all contents of the kit 100 including one or more clothing articles 13, diapers 14, and/or changing aids 15 are packaged together within a single vacuum sealable container 16. Additionally, one or more clothing articles 13, diapers 14, and/or changing aids 15 or any combination thereof, can be enclosed individually within separate sealed packaging prior to inclusion in a vacuum sealable container 16.

In preferred embodiments, vacuum sealing is performed on the vacuum sealable container 16 containing the clothing articles 13, diapers 14, and/or changing aids 15 so that excess air is removed from the vacuum sealable container 16, thus reducing the cumulative size of the vacuum sealable container 16 contents to create a vacuum sealed clothing and diaper change kit 100 (FIGS. 1, 3 and 4) thus providing a protective encasement for kit contents to reduce risk of loss, damage, or soiling. In some preferred embodiments, vacuum sealing may be performed using external or chamber vacuum sealers of commercial grade in order to create a sealed quality encasement and longer lasting seal although any suitable vacuum sealing method may be used. The vacuum sealable container 16 used for vacuum sealing may be of a composition such as flexible plastic so that a vacuum sealer is able to create an intended seal. The size of the final vacuum sealable container 16, defined by the length, width, and height of the total space occupied by the reduced size clothing article 13, diaper 14 and changing aid 15, may be for example, 5 inches in length, 5 inches in width, and 2 inches in height. Preferably, the aforementioned final size of the vacuum sealable container 16 dimensions do not include excess container material that extends past the contents of the kit 100, such as edges of the inner seal of the container and the outer seal of the container.

As shown in FIG. 3, in this embodiment kit 100 contains a vacuum compressed reduced size clothing article 15, a reduced size diaper 14, and optionally a changing aid 15 within the vacuum sealed container 16. The process of vacuum sealing has been applied to the vacuum sealable container 16, resulting in excess air being removed from container and therefore from one or more of its contents. In preferred embodiments, the vacuum sealable container 16 may comprise an opening or an open side which allows one or more clothing articles 13, diapers 14, and/or changing aids 15 to be placed into to the vacuum sealable container 16 prior to vacuum sealing. The vacuum sealing process seals vacuum sealable container 16 along an open side or opening, resulting in the vacuum sealable container 16 being sealed. The cumulative space occupied by the kit 100 and its contents is reduced by the vacuum sealing process. In other embodiments, a vacuum sealable container 16 may comprise one or more sealed sides. In further embodiments, additional clothing articles 13, diapers 14, and/or changing aids 15 may be vacuum sealed within the kit 100.

For example, according to at least one conventional vacuum-packing method known to those skilled in the relevant art, one or more articles such as a diaper 14, clothing article 13, and/or changing aid 15 (FIG. 2) to be vacuum-packed and in a first, un-reduced volumetric configuration may be inserted into an unsealed vacuum sealable container 16 formed of a substantially air impermeable flexible material. The unsealed vacuum sealable container 16 with the articles therein is then placed onto the deck of a vacuum-sealing machine. The lid of the machine is then lowered establishing a seal with the deck and to define a chamber between the deck and the lid with the unsealed encased article within the chamber. A pumping system then evacuates ambient air from the chamber creating at least a partial vacuum state within the chamber and within the interior space of the unsealed vacuum sealable container 16 with the article therein. Sealing bars then seal the vacuum sealable container 16 to maintain at least a partial vacuum state therein. Ambient air pressure is then restored to the chamber effecting a pressure differential across the sealed encasement. Insofar as the article within the sealed flexible vacuum sealable container 16 is compressible, the pressure differential acts upon the vacuum sealable container 16 to compress the articles within and maintains the articles in a reduced volume that is less than the volume of the articles at the time the vacuum sealable container 16 was sealed (before ambient air pressure was restored to the chamber). The lid of the machine is then raised and the vacuum-packed article is available for removal from the machine.

Upon evacuation of air from the encasement, the vacuum sealable container 16 can be sealed at a sealed edge 19, for example, or on another edge portion to maintain the vacuum within the vacuum sealable container 16 and diaper 14, clothing article 13, and/or changing aid 15 ("articles") (FIG. 2). In this manner, a differential pressure can be created within and without the vacuum sealable container 16 to maintain the second, reduced volumetric configuration of the diaper 14, clothing article 13, and/or changing aid 15. While the vacuum sealable container 16 is shown in FIG. 3 as sealed at sealed edge 19, it will be understood that the vacuum sealable container 16 can be sealed conventionally in a variety of ways in a variety of locations.

Also upon evacuation of air from the encasement, the vacuum sealable container 16 containing a diaper 14, clothing article 13, and/or changing aid 15 (FIG. 2) may be changed from a first, un-reduced volumetric configuration to a second, reduced volumetric configuration. As an example, by drawing a vacuum down to about 5 Mbar at room temperature and pressure at a location about 5,000 feet elevation above mean sea level, the volume of a vacuum sealable container 16 containing a diaper 14, clothing article 13, and/or changing aid 15 can be reduced to as little as one third or one fourth that of their first, un-reduced volumetric configuration volume. Similar results are to be expected at locations of different elevation. However, as is known, at lower elevations a greater vacuum can be drawn to allow for subsequent transportation of the kit 100 to higher elevations. For example, vacuum packaging using a vacuum down to 1 or 2 Mbar is common at lower elevations. Thus, in the space required to store one diaper 14, clothing article 13, and/or changing aid 15 in a first, un-reduced volumetric configuration, three, four, or more, diapers 14, clothing articles 13, and/or changing aids 15 packaged in accordance with the invention can be stored in a second, reduced volumetric configuration. The reduced volume kit 100 is not only advantageous in reducing storage space, but the space required for packaging, shipping, etc., is also reduced, leading to considerable cost savings in associated processes.

As shown in FIG. 3, in this embodiment of a kit 100, a clothing article 13, diaper 14, and/or changing aid 15 are packaged within a four sided vacuum sealable container 16. Three of the four sides of the vacuum sealable container 16 may be pre-sealed or joined together with a fourth side open or unsealed. In some embodiments, at minimum one open side of the vacuum sealable container 16 is needed inserting contents into a kit 100. In other embodiments, a vacuum sealable container 16 may comprise zero, one, or more pre-sealed or joined sides. Sides of a vacuum sealable container 16 may be sealed or joined by heat bonding, chemical bonding, adhesives, by being integrally molded or formed together, or any other suitable joining method capable of providing a substantially airtight seal or seam.

In preferred embodiments, one or more changing aids 15 may be positioned between one or more clothing articles 13 and one or more diapers 14. In other embodiments, one or more changing aids 15 may be positioned within a fold of one or more clothing articles 13 and/or within a fold of one or more diapers 14. In further embodiments, one or more clothing articles 13, diapers 14, and/or changing aids 15 may be packaged with a different order. In yet further embodiments, a kit 100 may comprise a plurality of changing aids, one or more of which may be optionally folded. In still further embodiments, a kit 100 may comprise a plurality of changing aids, one or more of which may be optionally folded and placed in or between a clothing article 13 and/or a diaper 14.

Figure 4A:
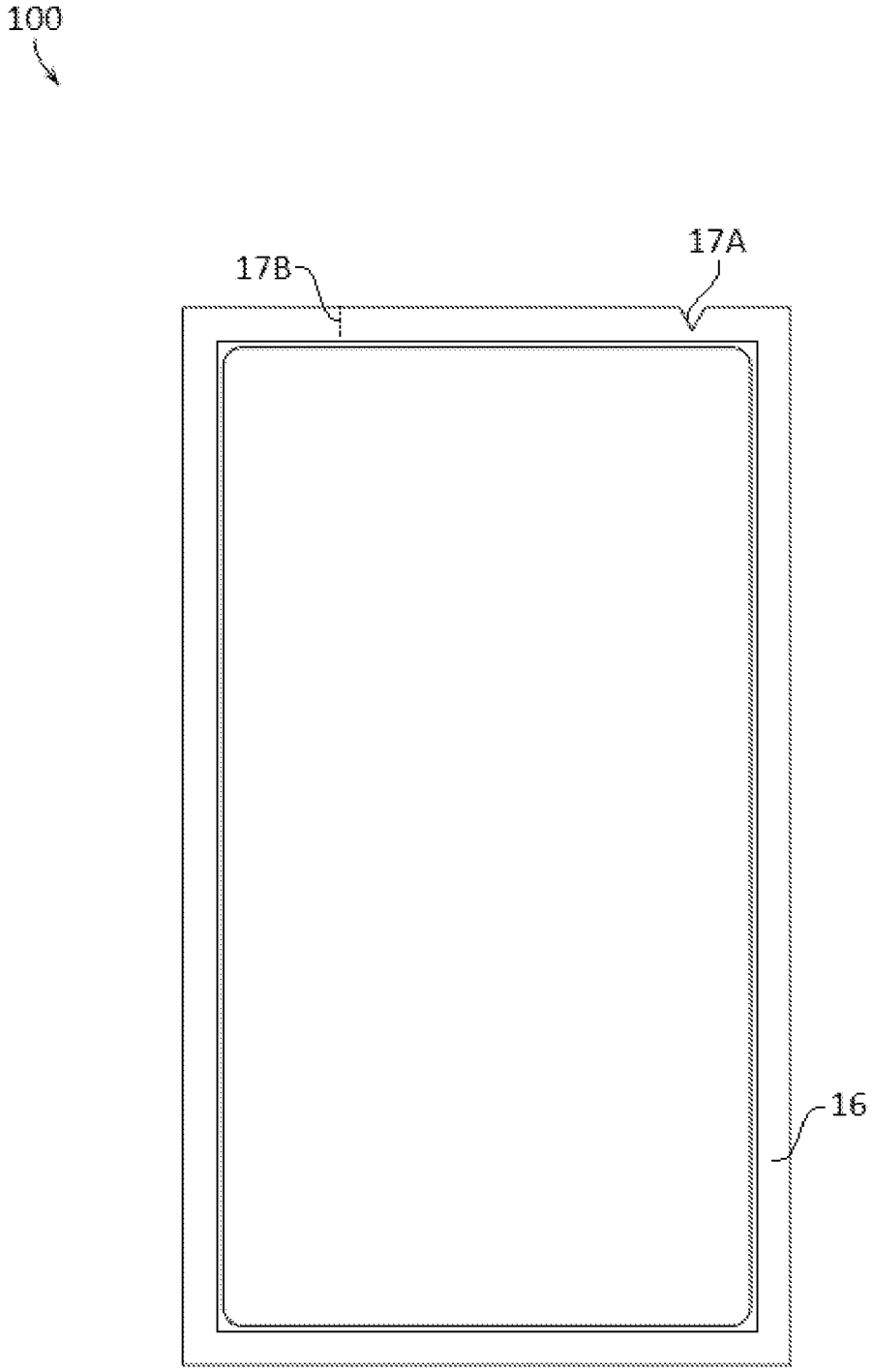
FIG. 4A depicts a plan view of the top of an example of a vacuum sealed clothing and diaper change kit according to various embodiments described herein.

FIG. 4A depicts a plan view showing the top of an example of a vacuum sealed clothing and diaper change kit 100 without an outer casing 11 according to various embodiments described herein. In some embodiments, a vacuum sealable container 16 may be made from a generally opaque material such as non-transparent plastic. In preferred embodiments, a vacuum sealable container 16 may be made from a substantially transparent or translucent material. For example, in embodiments comprising a substantially transparent vacuum sealable container 16, as shown in FIG. 4, only a clothing article 13 may be visible through the substantially transparent material. In other embodiments, one or more clothing articles 13, diapers 14, and/or changing aids 15 may be positioned within the kit 100 so as to be visible from the top, bottom, or sides of a substantially transparent vacuum sealable container 16. The process of vacuum sealing has been applied to the kit 100, resulting in excess air being removed from vacuum sealable container 16 and its contents.

As the vacuum sealable container 16 is configured to confine a diaper 14, clothing article 13, and/or changing aid 15 is unsealed, the diaper 14, clothing article 13, and/or changing aid 15 is able to return to their nominal volumetric configuration. That is, user can cut, tear, remove a portion of the vacuum sealable container 16, or otherwise break the airtight seal of the vacuum sealable container 16; after which, the diaper 14, clothing article 13, and/or changing aid 15 will no longer be subject to confining force due to the vacuum sealable container 16 and/or a pressure differential. Unopposed rebound forces in the materials from which the diaper 14, clothing article 13, and/or changing aid 15 are made will tend to return them to their nominal configuration.

In preferred embodiments, a kit 100 may comprise one or more means for facilitating the easy access of the contents. In some embodiments, a tear away for facilitating access may include a notch 17A which may preferably be "V" shaped or "U" shaped, and/or a perforated notch 17B, a slit notch, a rip cord, a tongue and groove fastener, or any other suitable method for facilitating the easy opening and unsealing of a kit 100 to facilitate access to the contents.

In some embodiments, a notch 17A which may be "V" or "U" shaped, and/or a perforated notch 17B may be located on or along the perimeter of a container 16 of kit 100 to allow simplified access to the contents. Preferably, a method for facilitating access allows for opening of the container 16 of kit 100 is by pulling on the outer seal of container 16 in opposite directions by hand at the site of a means for facilitating access such as a "V" shaped or "U" shaped notch 17A or a perforated notch 17B. In other embodiments, tear aways or other methods for facilitating access may be located on any one or more sealed sides of the kit 100.

Figure 4B:
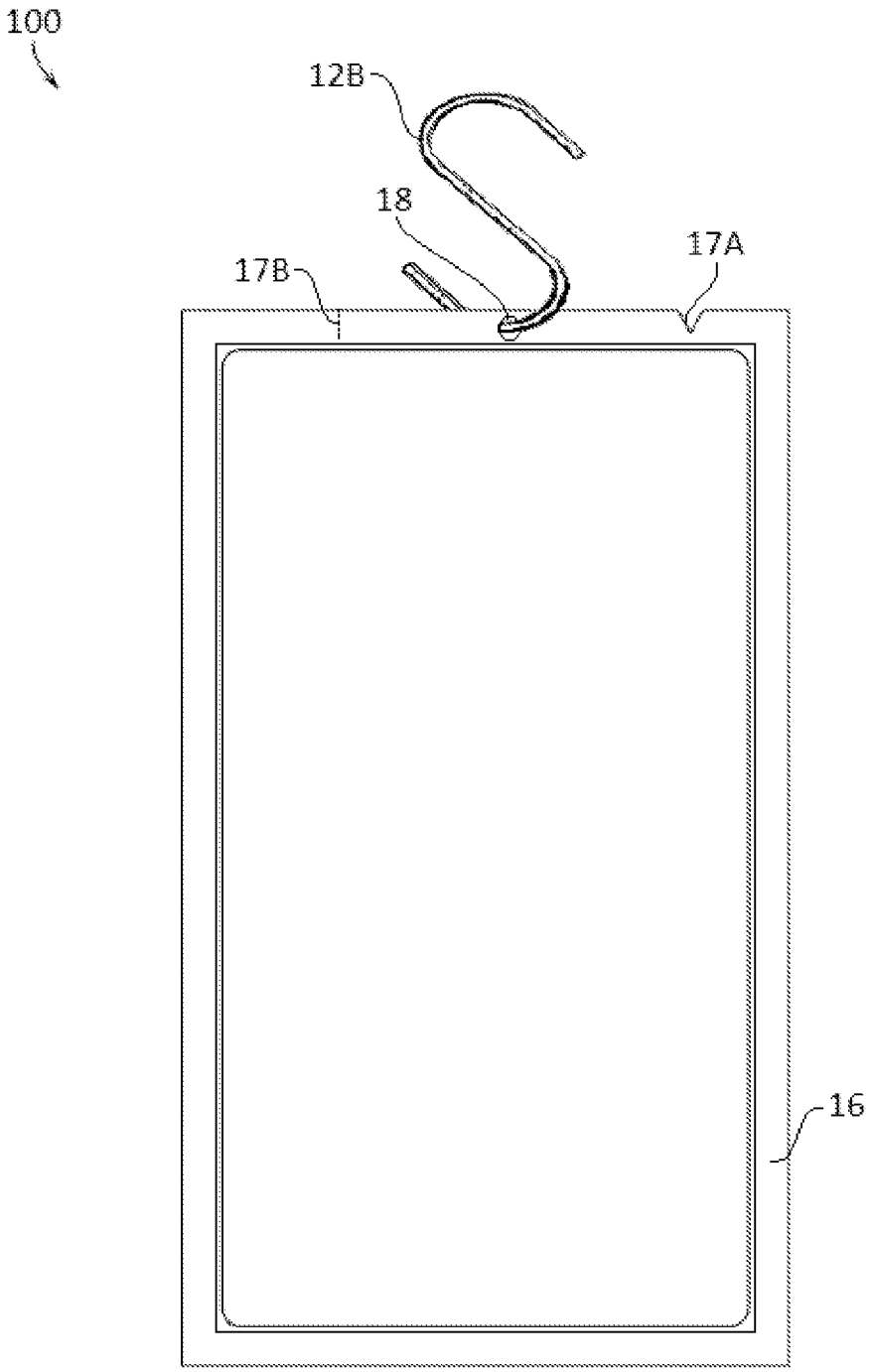
FIG. 4B illustrates a plan view of the top of an example of a vacuum sealed clothing and diaper change kit according to various embodiments described herein.

FIG. 4B illustrates a plan view of the top of an example of a vacuum sealed clothing and diaper change kit 100 according to various embodiments described herein. As shown in FIG. 4B, in this embodiment a vacuum sealable container 16 may comprise or be attached to one or more carrying accessory 12B which may be an S-hook as shown by FIG. 4B which may be directly attached to the vacuum sealable container 16 and/or to the outer casing 11 (FIG. 1) through a carrying accessory aperture 18. In some embodiments, a carrying accessory aperture 18 for securing a carrying accessory 12B to a container 16 or kit 100 may be reinforced with metal, rubber, or other suitable material. In alternative embodiments, a kit 100 may comprise a carrying accessory such as a fixed size lanyard which may be directly attached to a vacuum sealable container 16 and/or outer casing 11 through an optional carrying accessory aperture 18 on one end of the kit 100 which may be reinforced with metal, rubber, or other suitable material. In further embodiments, carrying accessories may comprise any suitable type to aid in the transportation and storage of the kit 100 and may be located on one or more sides of the optional outer casing 11 and/or on the vacuum sealable container 16, or provided as an optional accessory to be attached as the discretion of end consumers.

In some embodiments, a carrying accessory 12B such as a "S" hook may be temporarily joined to an outer casing 11 and/or on the vacuum sealable container 16 by being press fit or snap fit together, by one or more fasteners such as Velcro type fasteners, sealable tongue and groove fasteners, clip type fasteners, clasp type fasteners, ratchet type fasteners, threaded type fasteners such as screws and bolts, buckle type fasteners and the like, or any other suitable temporary joining method. In other embodiments, a carrying accessory 12B may be substantially permanently joined to an outer casing 11 and/or on the vacuum sealable container 16 with heat bonding, chemical bonding, adhesives, clasp type fasteners, clip type fasteners, rivet type fasteners, threaded type fasteners, other types of fasteners, by being integrally molded or formed together, or any other suitable substantially permanent joining method.

Figure 5:
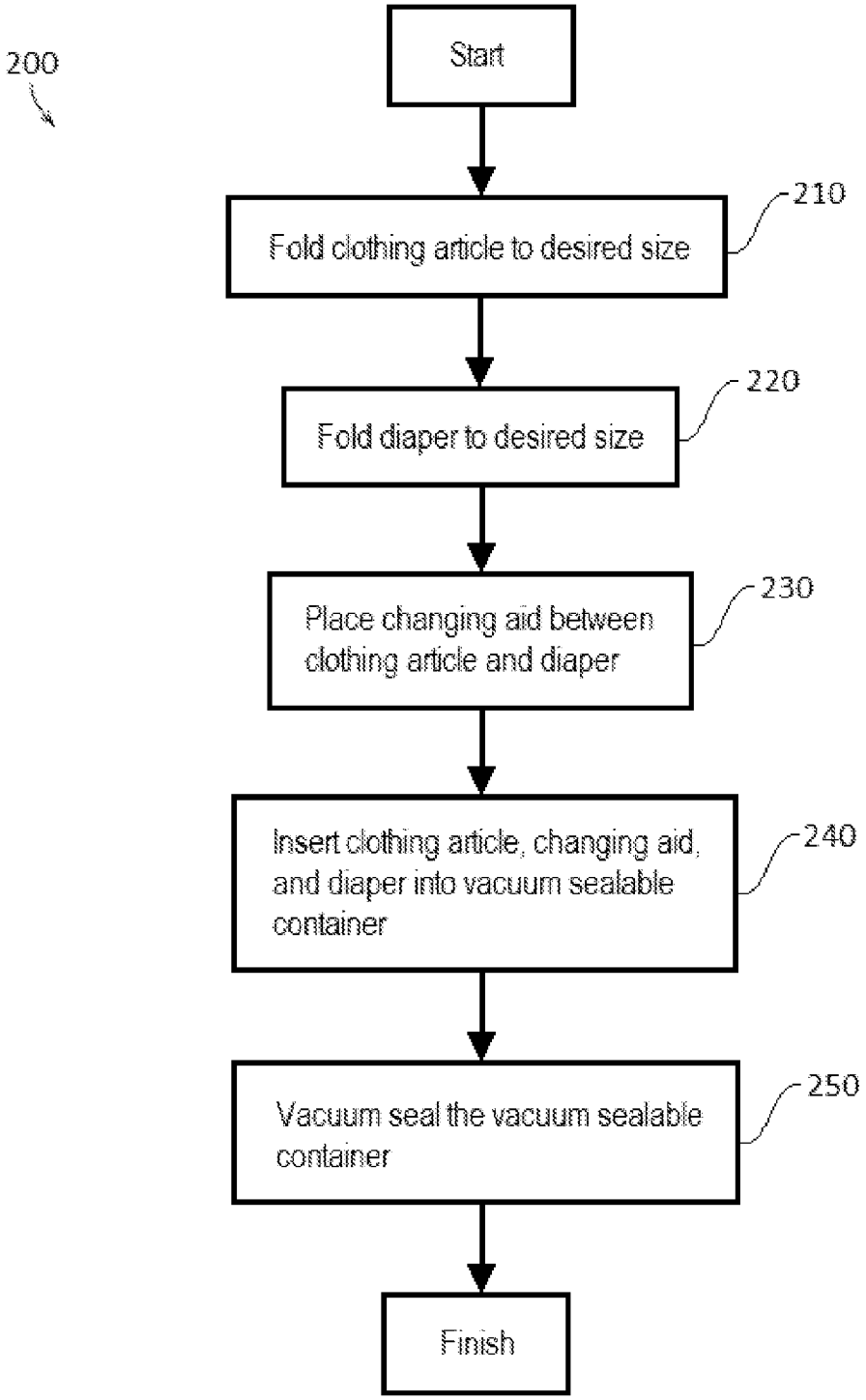
FIG. 5 shows a flow chart of an example of a process for providing a vacuum sealed clothing and diaper change kit according to various embodiments described herein.

FIG. 5 illustrates a flow chart the shows an example of a process 200 for providing a vacuum sealed clothing and diaper change kit according to various embodiments described herein. In some embodiments, a process 200 for providing a vacuum sealed clothing and diaper change kit may start by folding one or more clothing articles to a desired size in step 210. The clothing articles may be folded one or more times to reduce the length and width to a size for insertion into a vacuum sealable container 16 (FIGS. 2 and 3). Next, one or more diapers may be folded to the desired size in step 220 and preferably to a length and width similar to the one or more clothing articles of step 210. In alternative embodiments, step 220 may be completed before step 210. In step 230, optionally one or more changing aids may be placed between a clothing article and a diaper. In other embodiments, one or more changing aids may be optionally folded and placed within a folded clothing article and/or within a folded diaper. Next, the one or more clothing articles, diapers, and optional changing aids may be inserted into a vacuum sealable container in step 240. In step 250, the vacuum sealable container may be vacuum sealed and the process may finish.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A clothing and diaper change kit, the kit comprising;

an internal vacuum sealed container holding a folded clothing article, a folded diaper, and a changing aid, the folded clothing article in direct surface contact with the folded diaper within the internal vacuum sealed container;

an outer casing surrounding and housing the vacuum sealed container, the outer casing comprising an aperture adapted for receiving hooks and rack rails commonly used in retail storage settings; and wherein the folded clothing article, the folded diaper, and the changing aid are inserted into the internal vacuum sealed container at a first unreduced volumetric configuration and air is removed from the internal vacuum sealed container creating a second reduced volumetric configuration.

2. The kit of claim 1, wherein the changing aid is selected from the group consisting of dry wipes, moistened wipes, towelettes, diaper creams, over-the-counter medicated creams, over-the-counter medicated lotions, over-the-counter medicated ointments, prescription creams, prescription lotions, prescription ointments, non-medicated creams, non-medicated lotions, non-medicated ointments, powders, hand sanitizer, odor masking/diffuser such fragrance wipes, and plastic bags suitable for disposing of a soiled diaper.

3. The kit of claim 2, wherein the folded diaper is of a size suitable for a person of a first age and first size and the folded clothing article is of an appropriate size suitable for a person of the same first age and first size.

4. The kit of claim 3, wherein the container comprises a means to facilitate the opening of the internal vacuum sealed container by hand and without the need for a knife or scissors.

5. The kit of claim 4, wherein the means to facilitate the opening of the container is selected from the group consisting of a V-shaped notch, a U-shaped notch, and a perforated notch.

6. The kit of claim 5, wherein the internal vacuum sealed container comprises a sealed edge suitable for being sealed by a vacuum sealing machine.

7. The kit of claim 1, wherein the outer casing is cuboid shaped.

8. The kit of claim 1, wherein the outer casing comprises a cuboid shaped cardboard surface.

9. The kit of claim 1 wherein the outer casing comprises a cuboid shaped opaque cardboard surface having text and indicia printed on the cardboard surface.

10. The kit of claim 9, wherein the outer casing comprises a transparent opening adapted to display a portion of the internal vacuum sealed container.

11. The kit of claim 10, wherein the internal vacuum sealed container is constructed from a transparent plastic material.

12. The kit of claim 1, wherein the outer casing comprises a top protruding tab region, the top protruding tab region housing the aperture adapted for receiving hooks and rack rails commonly used in retail storage settings.

* * * * *